United States Patent [19]

Wilson et al.

[11] Patent Number: 5,029,654

[45] Date of Patent: Jul. 9, 1991

[54] BENDABLE DRILLING SUB

[76] Inventors: Murray Wilson, 4675 101A Ave. Apt #5, Edmonton, Alberta, Canada; Winston Smith, Gen. Del., Heisler, AB., Canada, T0B 2A0

[21] Appl. No.: 552,987

[22] Filed: Jul. 16, 1990

[51] Int. Cl.[5] ..... E21B 7/08

[52] U.S. Cl. ..... 175/74; 175/256

[58] Field of Search ..... 175/74, 75, 73, 256, 175/320; 285/184

[56] References Cited

U.S. PATENT DOCUMENTS

| | | | |
|---|---|---|---|
| 4,077,657 | 3/1978 | Trzeciak | 175/74 X |
| 4,220,214 | 9/1980 | Benoit | 175/74 X |
| 4,303,135 | 12/1981 | Benoit | 175/256 X |
| 4,522,272 | 6/1985 | Beimgraben | 175/74 |
| 4,694,914 | 9/1987 | Obrecht | 175/74 X |
| 4,745,982 | 5/1988 | Wenzel | 175/74 |
| 4,813,497 | 3/1989 | Wenzel | 175/74 |
| 4,817,740 | 4/1989 | Beimgraben | 175/74 |

*Primary Examiner*—Hoang C. Dang

*Attorney, Agent, or Firm*—George Haining Dunsmuir

[57] ABSTRACT

A bendable sub for use in the drilling string includes an elongated tubular mandrel with a threaded top end for mounting the mandrel at the bottom end of a drilling string, a lock nut threaded onto the body of the mandrel between the ends thereof for vertical movement, a coupler slidably mounted on the mandrel beneath the lock nut for movement between a release position and a locking position, the coupler being non-rotatable on the mandrel, a sleeve on the mandrel beneath the coupler with a tapering passage extending therethrough, a latch between the coupler and the sleeve for releasably connecting the coupler to the sleeve, and a retaining nut on the bottom end of the mandrel beneath the sleeve for retaining the latter on the mandrel, at least the bottom end of the coupler and the top end of the sleeve being inclined with respect to the longitudinal axis of the mandrel, whereby the sleeve can be tilted or inclined with respect to the mandrel to form a bend in the drilling sub.

6 Claims, 2 Drawing Sheets

BENDABLE DRILLING SUB

BACKGROUND OF THE INVENTION

This invention relates to a bendable drilling sub and in particular to an adjustable, bendable drilling sub.

So-called bent subs already exist. An example of such a sub is described in U.S. Pat. No. 4,745,982, which issued to K.H. Wenzel on May 24, 1988. The Wenzel sub includes a bent mandrel and sleeve or housing, which is also bent. The desired angular adjustment or bend between a downhole motor above the uphole end of the bent sub and the downhole or bit end of the bent sub is achieved by rotating the housing relative to the mandrel. The Wenzel device relies on accurately machined or cast mandrels and housings. Similarly, the adjustable sleeve is locked to the mandrel for rotation therewith clutches defined by two sets of mating teeth on the housing and on the sleeve. It will be readily apparent that such a complicated structure must be expensive to produce.

The object of the present invention is to overcome the problems inherent to devices of the type described above by providing a relatively simple bendable drilling sub.

BRIEF SUMMARY OF THE INVENTION

Accordingly, the present invention relates to a bendable drilling sub comprising elongated, tubular mandrel means; first thread means on a top end of said mandrel means for mounting said mandrel means in a drill string; lock nut means for mounting on said mandrel means, when on said mandrel means, said lock nut means being axially movable on said mandrel between a release and a locking position; coupler means for slidable mounting on said mandrel means beneath said lock nut means for movement between a release position and a locking position; sleeve means for mounting on said mandrel beneath said coupler means; tapered passage means extending from the top to the bottom of said sleeve means; latch means on said coupler means for releasably connecting said coupler means to said sleeve means; and retaining nut means for mounting on the bottom end of said mandrel means beneath said sleeve means for retaining said coupler means and said sleeve means on the mandrel, the bottom end of said coupler and the top end of said sleeve means inclined with respect to the longitudinal axis of said mandrel means, whereby said sleeve means can be inclined with respect to said mandrel means to form a bend in the sub.

BRIEF DESCRIPTION OF THE DRAWINGS

The invention will be described in greater detail with reference to the accompanying drawings, which illustrate a preferred embodiment of the invention, and wherein.

Figure 1:
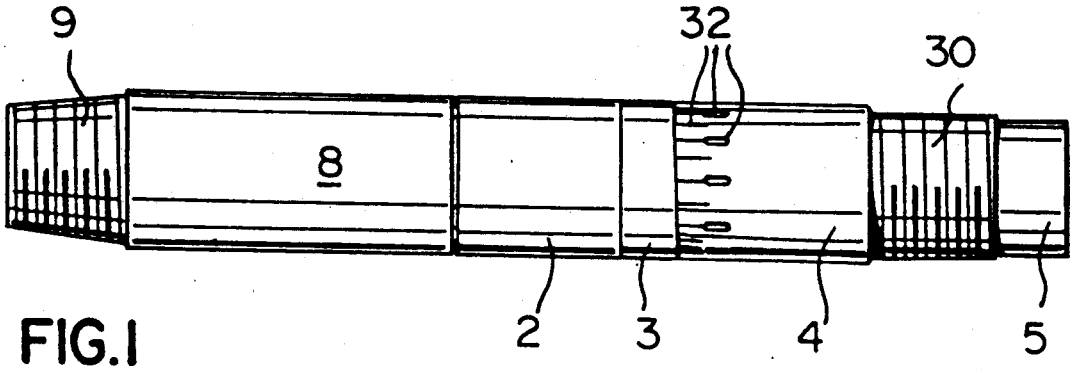
FIG. 1 is a schematic side elevational view of a bendable drilling sub in accordance with the present invention.

In the drawings, some angles have been exaggerated to facilitate understanding of the invention.

DESCRIPTION OF THE PREFERRED EMBODIMENT(S)

With reference to the drawings, the basic elements of the bent sub of the present invention include a mandrel generally indicated at 1, a lock nut 2, a coupler 3, a bottom sleeve 4 and a retaining nut 5.

Figure 2:
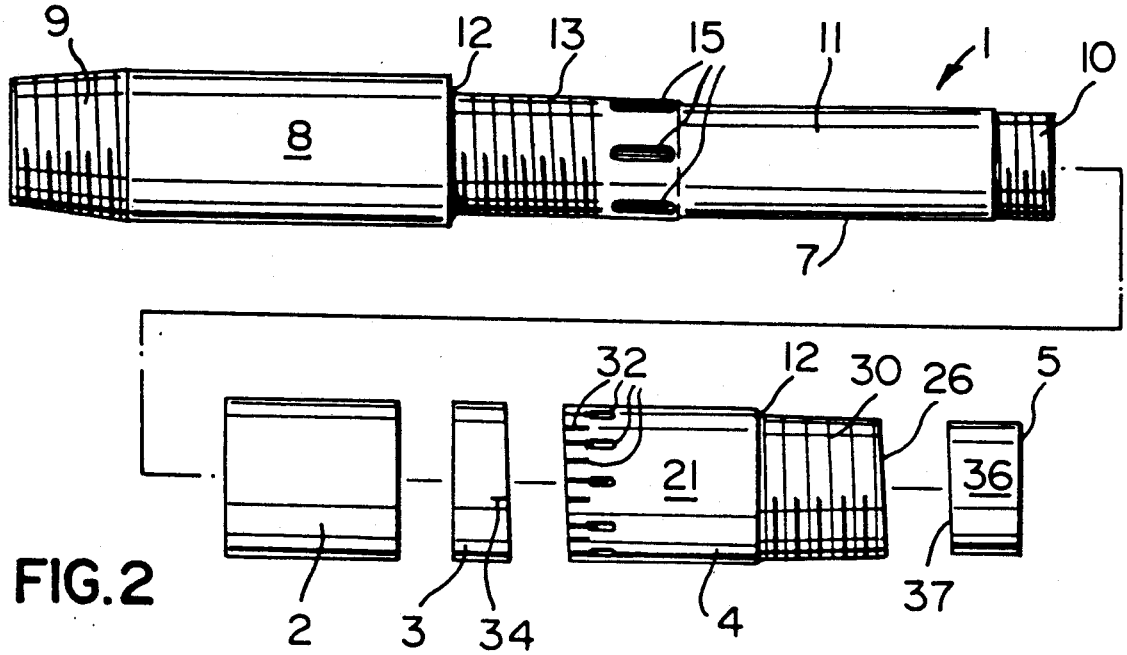
FIG. 2 is an exploded, side elevational view of the drilling sub of FIG. 1.

As best shown in FIG. 2, the mandrel 1 is defined by an elongated, generally cylindrical body 7, with a large diameter upper end portion 8. The end portion 8 has an externally threaded free end 9 for mounting the sub in a drill string. The top end 9 of the sub is connected to the stator of a mud motor (not shown), and the externally threaded, smaller diameter bottom end 10 is connected to a bearing stack (not shown) above the drill bit. The upper end portion 8 is connected to a smaller diameter lower portion 11 (FIG. 2) of the mandrel by a shoulder 12. Threads 13 are provided on the top end of the lower mandrel portion 11 for mounting the internally threaded nut 2 on the mandrel. A plurality of longitudinally extending grooves 15 are provided on the lower portion 11 of the mandrel beneath the threads 13 for receiving splines or keys (not shown) for connecting the annular coupler 3 to the mandrel. For such purpose, complementary, longitudinally extending grooves 16 are provided in the interior of the coupler 3, the grooves 16 being similar in number and spacing to the grooves 15. The coupler 3 is used to releasably secure the sleeve 4 in one of a plurality of positions on the mandrel 1. A ball 18 is mounted in the bottom end 19 of the coupler 3. The bottom end 19 of the coupler is inclined slightly with respect to the horizontal, i.e. with respect to the plane of the top end thereof.

Figure 3:
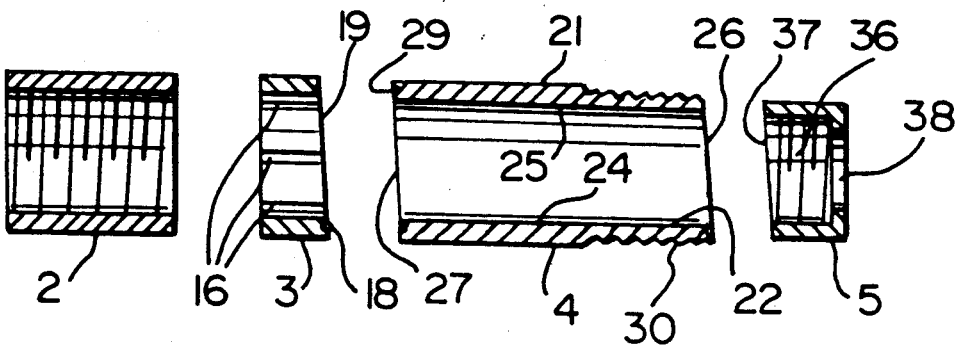
FIG. 3 is a longitudinal sectional view of all but one of the elements of the drilling sub of FIGS. 1
Figure 4:
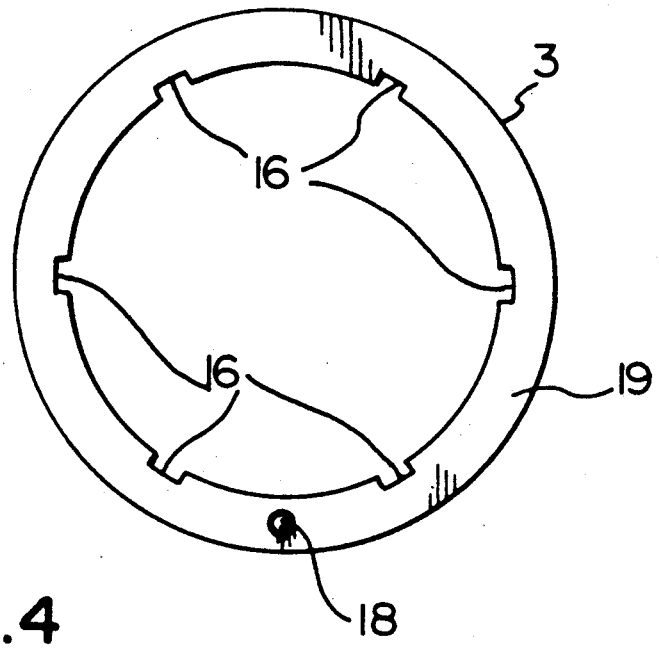
FIG. 4 is a bottom end view of a coupler used in the drilling sub of FIGS. 1 and 2.
Figure 5:
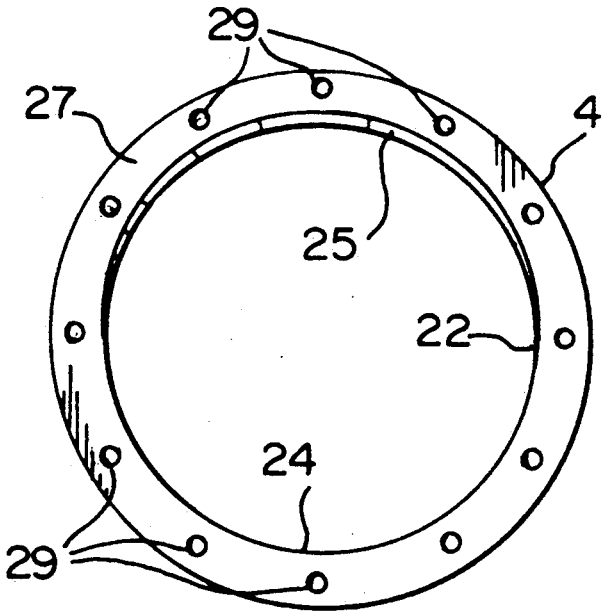
FIG. 5 is a top end view of a sleeve used in the drilling sub of FIGS. 1 and 2.

The sleeve 4 includes an elongated tubular, cylindrical body 21 with a downwardly (left to right in FIGS. 1 to 3) tapering passage 22 extending therethrough. The passage 22 is eccentric, one side 24 of the side wall being of constant thickness throughout its length and the other side 25 tapering slightly from the bottom 26 to the top end 27 thereof. A plurality of hemispherical recesses 29 are provided in the top end 27 of the sleeve 4 for receiving the ball 18. Of course, the ball 18 is located in one recess 29 only for any one angular setting of the sub. Thus the ball 18 and the recesses 29 define a latch device for releasable interconnecting the coupler 3 and the sleeve 4.

The bottom and top ends 26 and 27 of the sleeve 4 are also inclined with respect to the longitudinal axis thereof. Indices 32 are provided on the upper end of the outer surface of the sleeve 4 for alignment with a single indicia 34 on the coupler 3 for indicating the setting of the sleeve 4 with respect to the coupler 3 and the mandrel 1. Threads 30 are provided on the outer surface of the bottom end of the sleeve 4 for connecting the sleeve to a downhole portion of a drill string.

The retaining nut 5 is defined by a cylindrical, internally threaded body 36, with an inclined top end 37 and a radially inwardly extending, annular flange 38 at the bottom end thereof.

In use, the elements of the drilling sub are assembled in the manner shown in FIG. 1. In the assembled condition, the coupler 3 and the sleeve 4 are sandwiched between the nuts 2 and 5. The splines or keys in the grooves 15 and 16 prevent rotation of the coupler 3 relative to the mandrel 1. The ball 18 in one of the recesses 29 prevents rotation of the sleeve 4 relative to the coupler 3, and consequently relative to the mandrel 1. The angle of inclination of the sleeve 4, and consequently the inclination or bend of the drilling bit relative to the portion of the drill string above the sub is dictated by the setting of the sleeve 4 on the mandrel 1. In order to change the angle of inclination, the nut 2 is rotated to move it upwardly away from the coupler 3, the coupler 3 is slid axially upwardly to release the sleeve 4, and the latter is rotated to the new setting.

The eccentric, tapering passage 22 in the sleeve 4, and the opposed inclined ends 19 and 27 of the coupler 3 and the sleeve 4, respectively make it a relatively simple matter to adjust the inclination of the sleeve 4 relative to the longitudinal axes of the mandrel 1, the nut 2 and the coupler 3. The opposed bottom end 26 and the top end 37 of the retaining nut 5 are inclined, so that such ends will be in more or less complete contact even when the sleeve 4 is rotated. It is merely necessary to rotate the retaining nut 5 a corresponding amount. When the nut 2 is tightened to press the coupler 3 and the sleeve 4 towards the nut 5, the ball 18 mates with one of the recesses 29 and the top end 27 of the sleeve 4 to lock the sleeve 4 in one position. Thus, rotation of the mandrel results in a corresponding rotation of the sleeve 4.

It will be appreciated that a small bend in the sub can be effected by providing a tapering passage 22 in the sleeve 4, and inclined ends 19 and 27 on the coupler 3 and the sleeve 4, respectively. A 1% inclination of the ends 29 and 27 permits a 2% inclination or bend in the sub.

It will also be appreciated that the passage 22 in the sleeve 4 need not be eccentric, i.e. the passage can be of circular cross section throughout its length, tapering uniformly from the top end to the bottom end thereof.

What is claimed is:

1. A bendable drilling sub comprising elongated, tubular mandrel means having a single longitudinal axis extending the entire length thereof; first thread means on a top end of said mandrel means for mounting said mandrel means in a drill string; lock nut means for mounting on said mandrel means, when on said mandrel means, said lock nut means being axially movable on said mandrel means between a release and a locking position; coupler means for slidable mounting on said mandrel means beneath said lock nut means for movement between a release position and a locking position; sleeve means for mounting on said mandrel means beneath said coupler means; tapered passage means extending from the top to the bottom of said sleeve means; latch means on said coupler means for releasably connecting said coupler means to said sleeve means; and retaining nut means for mounting on the bottom end of said mandrel means beneath said sleeve means for retaining said coupler means and said sleeve means on the mandrel means, the bottom end of said coupler means and the top end of said sleeve means inclined with respect to the longitudinal axis of said mandrel means, whereby said sleeve means can be inclined with respect to said mandrel means to form a bend in the sub.

2. A drilling sub according to claim 1, wherein said tapered passage means is eccentric.

3. A drilling sub according to claim 1, wherein the bottom end of said sleeve means and the top end of said retaining nut means are inclined with respect to the longitudinal axis of said mandrel means permitting substantially full contact of the opposed ends of the sleeve means and the retaining nut means when said sleeve means and retaining nut means are rotated on the mandrel means.

4. A drilling sub according to claim 2, including a plurality of groove means in the outer surface of said mandrel means and in the inner surface of said coupler means; and spline means for insertion into said groove means for slidably connecting said coupler means to said mandrel means.

5. A drilling sub according to claim 1, wherein said latch means includes projection means on the bottom end of said coupler means; and recess means in the top end of said sleeve means for receiving said projection means.

6. A bendable drilling sub comprising elongated, tubular mandrel means having a single longitudinal axis extending the entire length thereof; first thread means on a top end of said mandrel means for mounting said mandrel means in a drill string; lock nut means for mounting on said mandrel means, when on said mandrel means, said lock nut means being axially movable on said mandrel means between a release and a locking position; coupler means for slidable mounting on said mandrel means beneath said lock nut means for movement between a release position and a locking position; sleeve means for mounting on said mandrel means beneath said coupler means; tapered passage means extending from the top to the bottom of said sleeve means; latch means on said sleeve means for releasably connecting said coupler means to said sleeve means, said latch means including a ball extending downwardly from the bottom end of said coupler means; and a plurality of recesses in the top end of said sleeve means for receiving said ball; and retaining nut means for mounting on the bottom end of said mandrel means beneath said sleeve means for retaining said coupler means and said sleeve means on the mandrel means, the bottom end of said coupler means and the top end of said sleeve means inclined with respect to the longitudinal axis of said mandrel means, whereby said sleeve means can be inclined with respect to said mandrel means to form a bend in the sub.

* * * * *